US009417547B2

(12) United States Patent
Toichi

(10) Patent No.: US 9,417,547 B2
(45) Date of Patent: Aug. 16, 2016

(54) IMAGE FORMING APPARATUS

(71) Applicant: KYOCERA Document Solutions Inc., Osaka (JP)

(72) Inventor: Tetsuya Toichi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/939,500

(22) Filed: Nov. 12, 2015

(65) Prior Publication Data

US 2016/0139527 A1 May 19, 2016

(30) Foreign Application Priority Data

Nov. 19, 2014 (JP) ..... 2014-234608

(51) Int. Cl.
*G03G 15/00* (2006.01)
*G03G 15/01* (2006.01)
*G03G 15/16* (2006.01)

(52) U.S. Cl.
CPC ..... *G03G 15/0131* (2013.01); *G03G 15/1665* (2013.01)

(58) Field of Classification Search
CPC ..... G03G 15/0189; G03G 15/1605–15/1695
See application file for complete search history.

(56) References Cited

U.S. PATENT DOCUMENTS 7,877,032 B2 1/2011 Takeuchi
2008/0187352 A1 8/2008 Takeuchi
2013/0322902 A1* 12/2013 Miyahara ..... G03G 15/0266 399/50
2015/0268592 A1* 9/2015 Ando ..... G03G 15/1605 399/66
2015/0309446 A1* 10/2015 Teramoto ..... G03G 15/16 399/66

FOREIGN PATENT DOCUMENTS

JP 2008-191596 A 8/2008

* cited by examiner

*Primary Examiner* — Walter L Lindsay, Jr.
*Assistant Examiner* — Ruifeng Pu
(74) *Attorney, Agent, or Firm* — Studebaker & Brackett PC

(57) ABSTRACT

An image forming apparatus includes development sections having development rollers, photosensitive drums, primary transfer rollers disposed opposite to the photosensitive drums in one-to-one correspondence, an intermediate transfer belt, and a voltage application section. The voltage application section includes a first voltage application section and a second voltage application section. In forced toner discharge from the development sections, the first voltage application section applies opposite polarity voltage between each of three upstream primary transfer rollers among the primary transfer rollers and the corresponding one of the photosensitive drums. The second voltage application section applies positive polarity voltage between a most downstream primary transfer roller and the corresponding one of the photosensitive drums.

10 Claims, 8 Drawing Sheets

| Three upstream regions | Most downstream region | Intermediate transfer belt cleaning ability |
|---|---|---|
| Primary transfer bias (opposite) (μA) | Primary transfer bias (opposite) (μA) | |
| 1 | 1 | B |
| 2 | 2 | B |
| 3 | 3 | B |
| 4 | 4 | B |
| 5 | 5 | B |

FIG. 8A

| Three upstream regions | Most downstream region | Intermediate transfer belt cleaning ability |
|---|---|---|
| Primary transfer bias (positive) (μA) | Primary transfer bias (opposite) (μA) | |
| −1 | 1 | A |
| −2 | 2 | A |
| −3 | 3 | A |
| −4 | 4 | A |
| −5 | 5 | A |

FIG. 8B

| Three upstream regions | Most downstream region | Intermediate transfer belt cleaning ability |
|---|---|---|
| Primary transfer bias (opposite) (μA) | Primary transfer bias (off) (μA) | |
| 1 | 0 | A |
| 2 | 0 | A |
| 3 | 0 | A |
| 4 | 0 | A |
| 5 | 0 | A |

FIG. 8C

| Three upstream regions | Most downstream region | Intermediate transfer belt cleaning ability |
|---|---|---|
| Primary transfer bias (opposite) (μA) | Primary transfer bias (positive) (μA) | |
| 1 | −3 | A |
| 2 | −3 | A |
| 3 | −3 | A |
| 4 | −3 | A |
| 5 | −3 | A |

FIG. 8D

| Three upstream regions | Most downstream region | Intermediate transfer belt cleaning ability |
|---|---|---|
| Primary transfer bias (opposite) (μA) | Primary transfer bias (positive) (μA) | |
| 1 | −5 | A |
| 2 | −5 | A |
| 3 | −5 | A |
| 4 | −5 | A |
| 5 | −5 | A |

FIG. 8E

IMAGE FORMING APPARATUS

INCORPORATION BY REFERENCE

The present application claims priority under 35 U.S.C. §119 to Japanese Patent Application No. 2014-234608, filed on Nov. 19, 2014. The contents of this application are incorporated herein by reference in their entirety.

BACKGROUND

The present disclosure relates to an image forming apparatus.

Image forming apparatuses are known to remove toner adhering to an intermediate transfer belt using a cleaning device.

For example, an image forming apparatus is disclosed in which the voltage that is applied to a transfer roller in forced toner discharge is of a polarity opposite to the voltage that is applied to the transfer roller in printing. This image forming apparatus applies a voltage of 1 kV to the transfer roller in the forced toner discharge, which is 200 V higher than an electrical breakdown voltage of 800 V at a region where an image is transferred.

The above-described image forming apparatus is disclosed to be capable of quickly and sufficiently cleaning the intermediate transfer belt using a cleaning device therein in the forced toner discharge.

SUMMARY

An image forming apparatus according to a first aspect of the present disclosure is an image forming apparatus for forming an image on a recording medium. The image forming apparatus includes a plurality of photosensitive drums, a plurality of development sections, a plurality of primary transfer rollers, an intermediate transfer belt, and a voltage application section. The plurality of development sections are provided in one-to-one correspondence with the photosensitive drums and supply toners to the respective photosensitive drums to from toner images each having a different color on the respective photosensitive drums. The plurality of primary transfer rollers are disposed opposite to the photosensitive drums in one-to-one correspondence. The intermediate transfer belt is held between the photosensitive drums and the primary transfer rollers. The toner images are transferred onto the intermediate transfer belt such that the toner images are superimposed on one another for forming the image. The voltage application section applies voltage to a plurality of voltage application regions between each of the photosensitive drums and the corresponding one of the primary transfer rollers. In forced toner discharge from the development sections, the voltage application section applies voltage of the same polarity to each voltage application region other than a most downstream voltage application region located most downstream in a traveling direction of the intermediate transfer belt among the plurality of voltage application regions and applies, to the most downstream voltage application region, voltage of a polarity opposite to the polarity of the voltage that is applied to each voltage application region other than the most downstream voltage application region.

An image forming apparatus according to a second aspect of the present disclosure is an image forming apparatus for forming an image on a recording medium. The image forming apparatus includes a plurality of photosensitive drums, a plurality of development sections, a plurality of primary transfer rollers, an intermediate transfer belt, and a voltage application section. The plurality of development sections are provided in one-to-one correspondence with the photosensitive drums and supply toners to the respective photosensitive drums to from toner images each having a different color on the respective photosensitive drums. The plurality of primary transfer rollers are disposed opposite to the photosensitive drums in one-to-one correspondence. The intermediate transfer belt is held between the photosensitive drums and the primary transfer rollers. The toner images are transferred onto the intermediate transfer belt such that the toner images are superimposed on one another for forming the image. The voltage application section applies voltage to a plurality of voltage application regions between each of the photosensitive drums and the corresponding one of the primary transfer rollers. In forced toner discharge from the development sections, the voltage application section applies voltage of the same polarity to each voltage application region other than a most downstream voltage application region located most downstream in a traveling direction of the intermediate transfer belt among the plurality of voltage application regions and applies substantially no voltage to the most downstream voltage application region.

BRIEF DESCRIPTION OF THE DRAWINGS

FIGS. 8A to 8E are tables for evaluation of results of cleaning performed by a blade according to configurations illustrated in FIGS. 5 to 7. FIG. 8A shows results of the cleaning according to the first comparative example. FIG. 8B shows results of the cleaning according to the second embodiment. FIGS. 8C to 8E show results of the cleaning according to the first embodiment.

DETAILED DESCRIPTION

Figure 1:
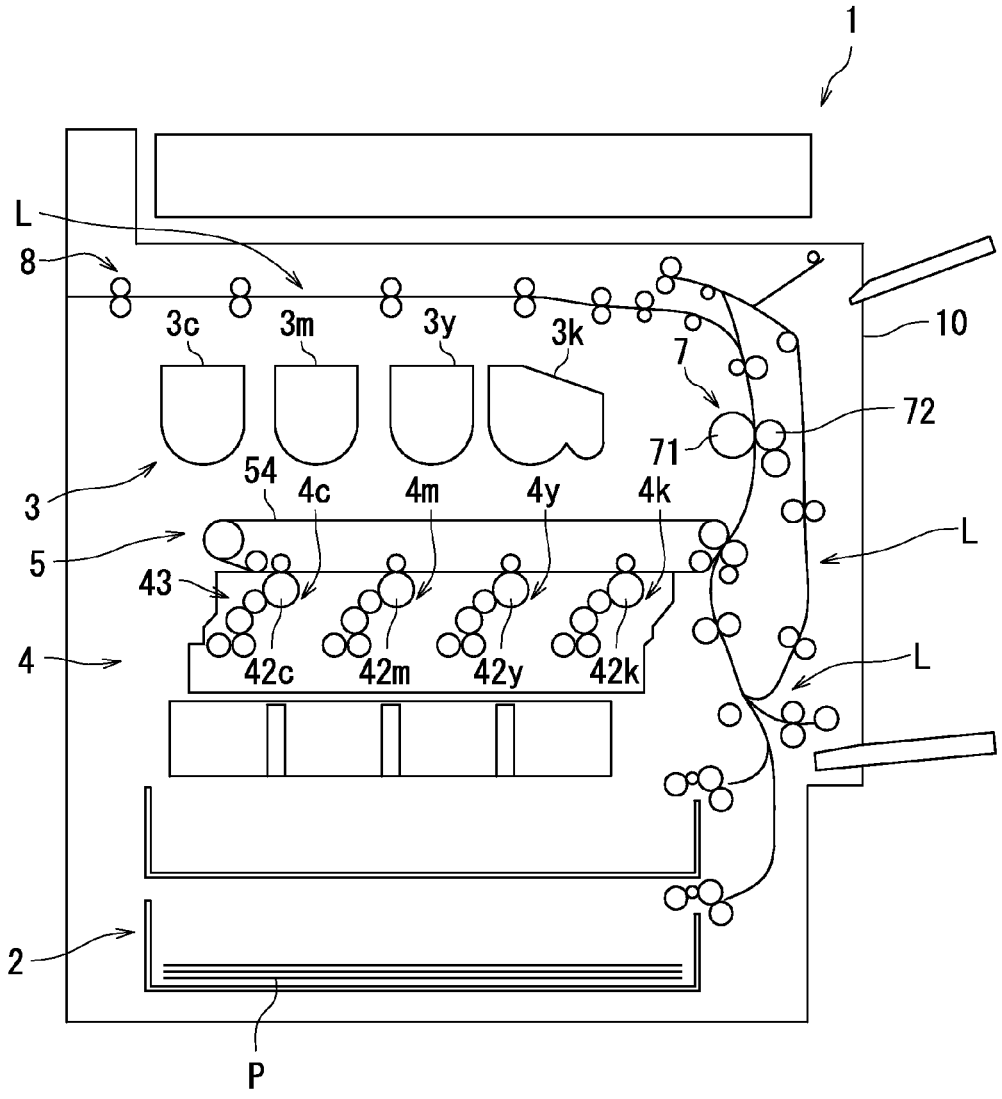
FIG. 1 is a side view illustrating configuration of an image forming apparatus according to an embodiment of the present disclosure.

Hereinafter, embodiments of the present disclosure will be described with reference to the accompanying drawings (FIGS. 1 to 8E). It should be noted that elements in the drawings that are the same or equivalent are labelled using the same reference signs and explanation thereof is not repeated.

First, an image forming apparatus 1 according to an embodiment of the present disclosure will be described with reference to FIG. 1. FIG. 1 is a diagram illustrating configuration of the image forming apparatus 1 according to the present embodiment. In the present embodiment, the image forming apparatus 1 is a color copier.

As illustrated in FIG. 1, the image forming apparatus 1 is an apparatus that forms an image on recording paper P and includes a housing 10, a paper feed section 2, a conveyance section L, a toner replenishment unit 3, an image forming unit 4, a transfer section 5, a fixing section 7, and an ejecting section 8.

The paper feed section 2 is disposed in a lower part of the housing 10 and feeds the recording paper P to the conveyance section L. The paper feed section 2 can contain a plurality of sheets of recording paper P and picks up an uppermost sheet of recording paper P to feed the sheets of recording paper P to the conveyance section L one sheet at a time. Hereinafter, the recording paper P will be referred to as paper P in order to facilitate description.

The conveyance section L conveys the paper P fed by the paper feed section 2 to the ejecting section 8 through the transfer section 5 and the fixing section 7.

The toner replenishment unit 3 is a container for replenishing the image forming unit 4 with toner and includes four toner cartridges 3*c*, 3*m*, 3*y*, and 3*k*. The toner cartridge 3*c* contains a cyan toner. The toner cartridge 3*m* contains a magenta toner. The toner cartridge 3*y* contains a yellow toner. The toner cartridge 3*k* contains a black toner.

Hereinafter, the toner cartridges 3*c*, 3*m*, and 3*y* may be referred to as color toner cartridges 31, and the toner cartridge 3*k* may be referred to as a black toner cartridge 32.

The transfer section 5 includes an intermediate transfer belt 54. The transfer section 5 transfers toner images formed by the image forming unit 4 from the intermediate transfer belt 54 onto paper P. Configuration of the transfer section 5 will be described later with reference to FIG. 2.

The image forming unit 4 forms toner images on the intermediate transfer belt 54. The image forming unit 4 receives the color toners from the respective color toner cartridges 31 and the black toner from the black toner cartridge 32. More specifically, the image forming unit 4 includes four image forming sections 4*c*, 4*m*, 4*y*, and 4*k*. The image forming section 4*c* receives the cyan toner from the toner cartridge 3*c*. The image forming section 4*m* receives the magenta toner from the toner cartridge 3*m*. The image forming section 4*y* receives the yellow toner from the toner cartridge 3*y*. The image forming section 4*k* receives the black toner from the toner cartridge 3*k*. Configuration of the image forming unit 4 will be described later with reference to FIG. 2.

The fixing section 7 has a pair of rollers including a heating roller 71 and a pressure roller 72 that fix toner images formed on the paper P by the transfer section 5. The heating roller 71 and the pressure roller 72 apply heat and pressure to the paper P. Thus, the unfixed toner images transferred onto the paper P by the transfer section 5 are fixed by the fixing section 7.

The ejecting section 8 ejects the paper P having the toner images fixed thereon to the outside of the apparatus.

Figure 2:
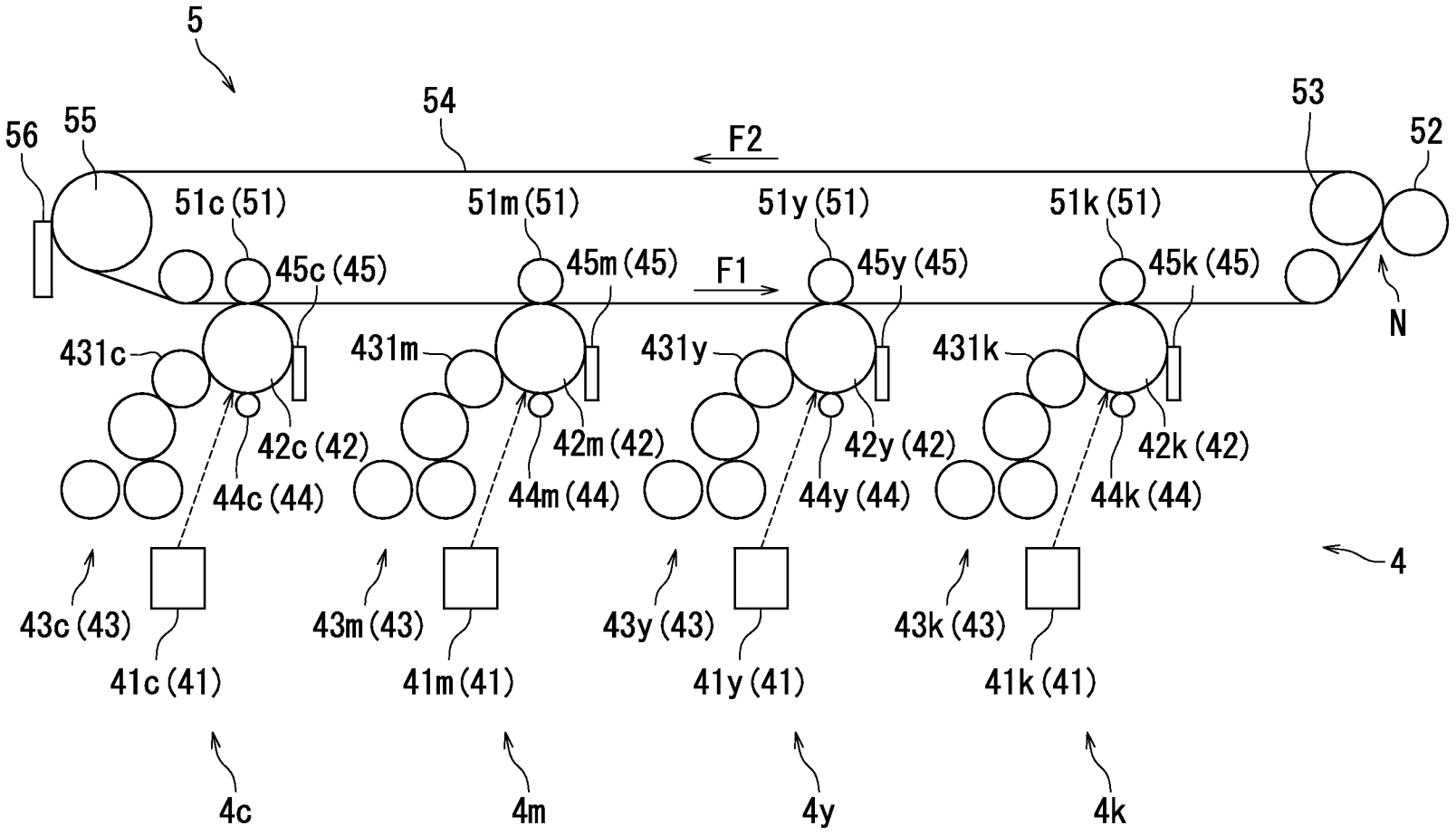
FIG. 2 is a side view illustrating configuration of an image forming unit and a transfer section illustrated in FIG. 1.

Next, configuration of the image forming unit 4 and the transfer section 5 will be described with reference to FIG. 2. FIG. 2 is a side view illustrating configuration of the image forming unit 4 and the transfer section 5. As illustrated in FIG. 2, the image forming unit 4 includes the four image forming sections 4*c*, 4*m*, 4*y*, and 4*k*.

The image forming sections 4*c*, 4*m*, 4*y*, and 4*k* each include a light exposure device 41, a photosensitive drum 42, a development section 43, a charging roller 44, and a cleaning blade 45. The four image forming sections 4*c*, 4*m*, 4*y*, and 4*k* each supply a toner of a different color and otherwise have substantially the same configuration. Herein, therefore, the configuration of the image forming section 4*c* that receives the cyan toner will be described, and description of the configuration of the other image forming sections 4*m*, 4*y*, and 4*k* will be omitted.

The image forming section 4*c* has a light exposure section 41*c* (41), a photosensitive drum 42*c* (42), a development section 43*c* (43), a charging roller 44*c* (44), and a cleaning blade 45*c* (45).

The charging roller 44*c* charges the photosensitive drum 42*c* to a specific electric potential. The light exposure section 41*c* performs light exposure on the photosensitive drum 42*c* by irradiating laser light thereto to form an electrostatic latent image on the photosensitive drum 42*c*. The development section 43*c* has a development roller 431*c*. The development roller 431*c* supplies the cyan toner to the photosensitive drum 42*c* to develop the electrostatic latent image into a toner image. Thus, a cyan toner image is formed on a peripheral surface of the photosensitive drum 42*c*.

The cleaning blade 45*c* has an edge (an upper edge in FIG. 2) in rubbing contact with the peripheral surface of the photosensitive drum 42*c*. The edge of the cleaning blade 45*c* in rubbing contact with the peripheral surface of the photosensitive drum 42*c* removes residual cyan toner on the peripheral surface of the photosensitive drum 42*c*.

The transfer section 5 transfers the toner image onto paper P (see FIG. 1). The transfer section 5 includes four primary transfer rollers 51 (51*c*, 51*m*, 51*y*, and 51*k*), a secondary transfer roller 52, a drive roller 53, the intermediate transfer belt 54, and a driven roller 55.

The transfer section 5 transfers toner images formed on the photosensitive drums 42 (42*c*, 42*m*, 42*y*, and 42*k*) of the respective image forming sections 4*c*, 4*m*, 4*y*, and 4*k* onto the intermediate transfer belt 54 such that the toner images are superimposed on one another. The transfer section 5 subsequently transfers the superimposed toner images from the intermediate transfer belt 54 to the paper P (see FIG. 1).

The primary transfer roller 51*c* is disposed opposite to the photosensitive drum 42*c* with the intermediate transfer belt 54 therebetween. The primary transfer roller 51*c* can be pressed into contact with the photosensitive drum 42*c* with the intermediate transfer belt 54 therebetween and separated from the photosensitive drum 42*c* by a drive mechanism (not shown). In a normal state, the primary transfer roller 51*c* is in pressed contact with the photosensitive drum 42*c* with the intermediate transfer belt 54 therebetween. Like the primary transfer roller 51*c*, the other primary transfer rollers 51*m*, 51*y*, and 51*k* are each in pressed contact with the corresponding photosensitive drum 42 (42*m*, 42*y*, or 42*k*) with the intermediate transfer belt 54 therebetween.

The drive roller 53 is disposed opposite to the secondary transfer roller 52 and drives the intermediate transfer belt 54.

The intermediate transfer belt 54 is an endless belt wound around the four primary transfer rollers 51, the drive roller 53, and the driven roller 55. The intermediate transfer belt 54 is driven by the drive roller 53 to rotate in a counterclockwise direction as indicated by arrows F1 and F2 in FIG. 2. The intermediate transfer belt 54 has an outer surface in contact with the peripheral surface of each of the photosensitive drums 42 (42*c*, 42*m*, 42*y*, and 42*k*). The primary transfer rollers 51 (51*c*, 51*m*, 51*y*, and 51*y*) transfer toner images from the photosensitive drums 42 (42*c*, 42*m*, 42*y*, and 42*k*) to the outer surface of the intermediate transfer belt 54.

Specifically, the intermediate transfer belt 54 is a seamless belt made from a resin such as polyimide, polycarbonate, and polyvinylidene fluoride.

The driven roller 55 is driven to rotate by the rotation of the intermediate transfer belt 54. A blade 56 is disposed at a location opposite to the driven roller 55 with the intermediate transfer belt 54 therebetween. The blade 56 removes residual toner on the outer surface of the intermediate transfer belt 54.

The secondary transfer roller 52 is pressed against the drive roller 53. The secondary transfer roller 52 and the drive roller 53 in such an arrangement form a nip N therebetween. The secondary transfer roller 52 and the drive roller 53 transfer the toner images from the intermediate transfer belt 54 to paper P (see FIG. 1) while the paper P is passing through the nip N.

Next, "forced toner discharge" will be described. The following process is performed in order to adjust the charge state of the toners in the development sections 43 (43*c*, 43*m*, 43*y*, and 43*k*) (or in order to prevent deterioration of the toners). That is, the toners in the development sections 43 (43*c*, 43*m*, 43*y*, and 43*k*) are each forced out to the photosensitive drums 42 (42*c*, 42*m*, 42*y*, and 42*k*) at a predetermined timing to form toner images.

Unused toners in amounts that make up for the amounts of the toners forced out from the development sections 43 (43*c*, 43*m*, 43*y*, or 43*k*) are supplied from the toner replenishment unit 3 (the toner cartridges 3*c*, 3*m*, 3*y*, and 3*k*). Thus, the charge state of the toners in the development sections 43 (43*c*, 43*m*, 43*y*, and 43*k*) is adjusted. The above-described process is referred to as "forced toner discharge". The predetermined timing is for example every time a predetermined number of pages (for example, 10 pages) are printed or every time a predetermined period of time (for example, 1 minute) elapses.

In the case of the "forced toner discharge", as in the case of printing, toner images formed on the respective photosensitive drums 42 (42*c*, 42*m*, 42*y*, and 42*k*) of the image forming sections 4*c*, 4*m*, 4*y*, and 4*k* are transferred onto the intermediate transfer belt 54 such that the toner images are superimposed on one another.

Since discharging of the respective toners from the development sections 43 (43*c*, 43*m*, 43*y*, and 43*k*) is timed so that the toner images are transferred to be superimposed on one another on the intermediate transfer belt 54, the time taken for the "forced toner discharge" can be reduced.

However, the toner images are not transferred from the intermediate transfer belt 54 to paper P by the secondary transfer roller 52 and the drive roller 53 in the case of the "forced toner discharge". More specifically, paper P is not conveyed to the secondary transfer roller 52 and the drive roller 53 in the case of the "forced toner discharge". Furthermore, the secondary transfer roller 52 and the drive roller 53 do not apply heat to the toners on the intermediate transfer belt 54 in the case of the "forced toner discharge". Accordingly, the toners transferred from the photosensitive drums 42 (42*c*, 42*m*, 42*y*, and 42*k*) to the intermediate transfer belt 54 are conveyed to the blade 56 and removed by the blade 56 in the case of the "forced toner discharge".

Figure 3:
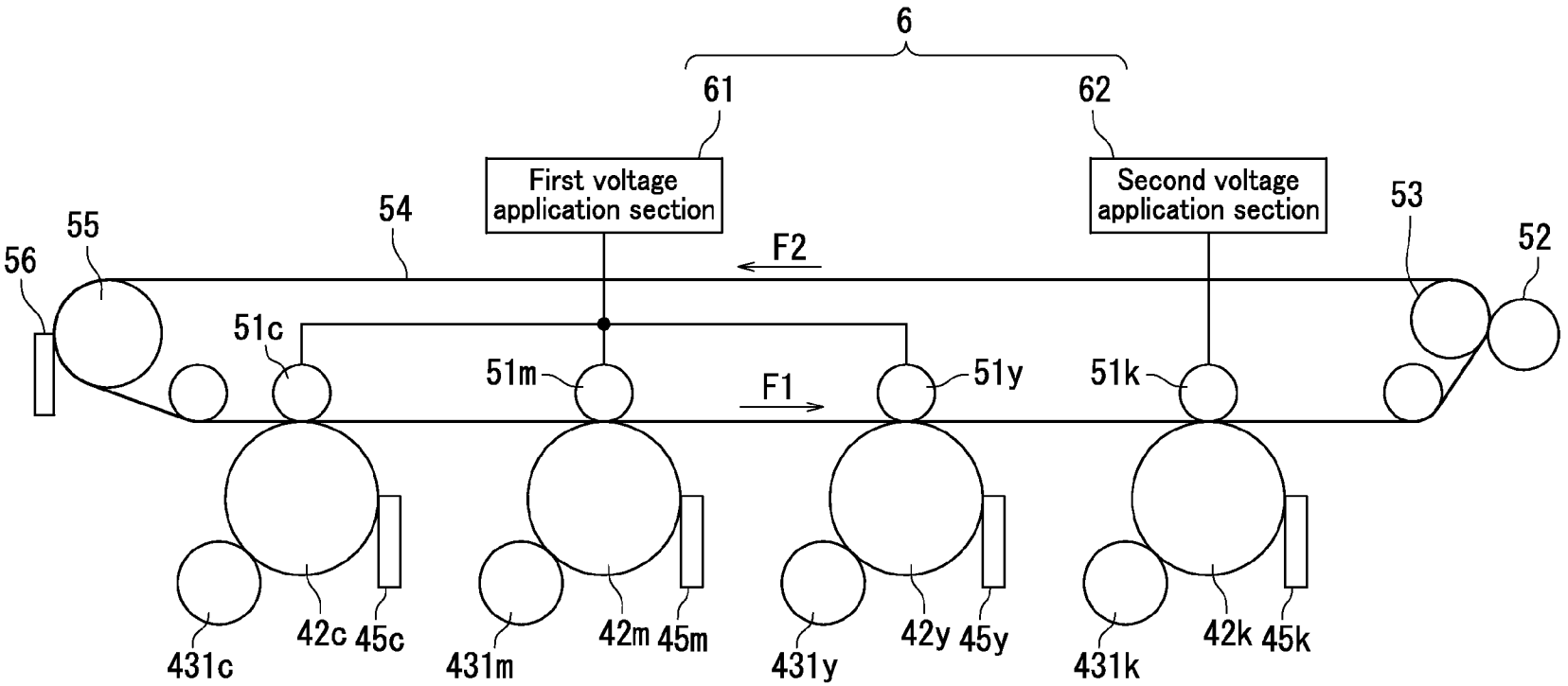
FIG. 3 is a side view illustrating configuration of a voltage application section that applies voltage to primary transfer rollers illustrated in FIG. 2.

Next, a voltage application section 6 that applies voltage between each primary transfer roller 51 and the corresponding photosensitive drum 42 will be described with reference to FIG. 3. FIG. 3 is a side view illustrating configuration of the voltage application section 6 that applies voltage to each primary transfer roller 51 illustrated in FIG. 2. The voltage application section 6 includes a first voltage application section 61 and a second voltage application section 62.

The first voltage application section 61 controls voltage to be applied between each of three primary transfer rollers 51 (51*c*, 51*m*, and 51*y*) located upstream in a traveling direction of the intermediate transfer belt 54 and a corresponding one of the photosensitive drums 42 (42*c*, 42*m*, and 42*y*). More specifically, the first voltage application section 61 controls the voltage to be applied between the primary transfer roller 51*c* and the photosensitive drum 42*c*, between the primary transfer roller 51*m* and the photosensitive drum 42*m*, and between the primary transfer roller 51*y* and the photosensitive drum 42*y*. A region between the primary transfer roller 51*c* and the photosensitive drum 42*c*, a region between the primary transfer roller 51*m* and the photosensitive drum 42*m*, and a region between the primary transfer roller 51*y* and the photosensitive drum 42*y* are each equivalent to one "voltage application region".

The second voltage application section 62 controls voltage to be applied between the primary transfer roller 51*k* located most downstream in a traveling direction of the intermediate transfer belt 54 and the photosensitive drum 42*k*. A region between the primary transfer roller 51*k* and the photosensitive drum 42*k* is equivalent to one "voltage application region" that is the "most downstream voltage application region".

In the present embodiment, a configuration is described in which the voltage application section 6 includes the first voltage application section 61 and the second voltage application section 62. However, a different configuration may be employed so long as the voltage application section 6 includes the second voltage application section 62. In other words, a different configuration may be employed so long as the voltage to be applied between the most downstream primary transfer roller 51*k* and the photosensitive drum 42*k* can be controlled independently from the voltage to be applied between the three other primary transfer rollers 51 and the three other photosensitive drums 42. For example, a configuration may be employed in which the voltage application section 6 controls the voltage to be applied between the four primary transfer rollers 51 and the four photosensitive drums 42 independently. That is, the voltage to be applied between the four primary transfer rollers 51 and the four photosensitive drums 42 refers to the voltage to be applied between the primary transfer roller 51*c* and the photosensitive drum 42*c*, the voltage to be applied between the primary transfer roller 51*m* and the photosensitive drum 42*m*, the voltage to be applied between the primary transfer roller 51*y* and the photosensitive drum 42*y*, and the voltage to be applied between the primary transfer roller 51*k* and the photosensitive drum 42*k*.

Figure 4:
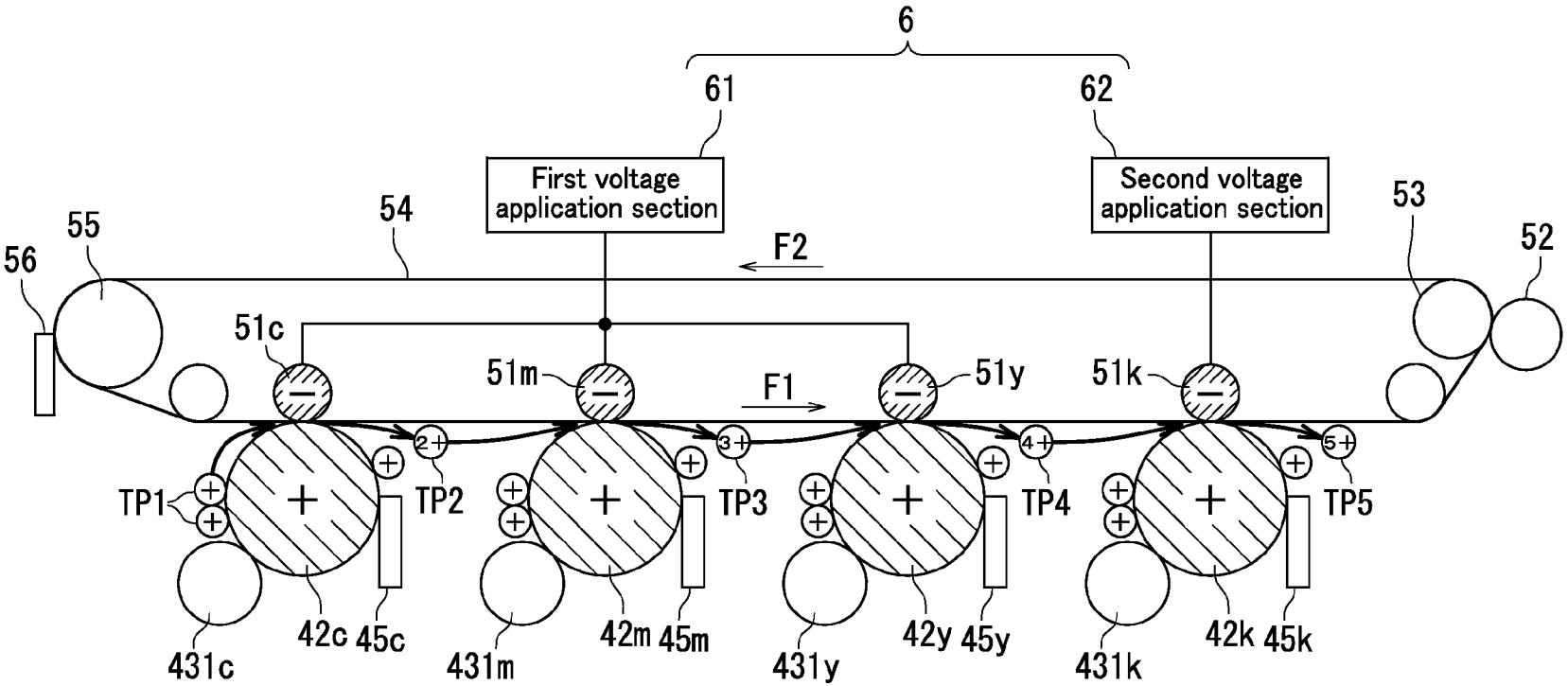
FIG. 4 is a side view of the image forming unit illustrated in FIG. 2, illustrating toner behavior when images are formed on an intermediate transfer belt.

Next, the voltage to be applied by the first voltage application section 61 and the second voltage application section 62 for forming an image on paper P will be described. FIG. 4 is a side view of the image forming unit 4 and the transfer section 5 illustrated in FIG. 2, illustrating toner behavior when an image is formed on paper P. In the present embodiment, a configuration is described in which positively charged toners are used to form an image on paper P.

Next, the toner behavior will be described with reference to FIG. 4. In FIGS. 4 to 7, "TP1" to "TP5" represent positively charged toners, and "TM1" to "TM5" represent negatively charged toners. Charges QP1, QP2, QP3, QP4, and QP5 of the respective toners TP1, TP2, TP3, TP4, and TP5 satisfy the relationship represented by the expression (1). A "charge" referred to herein means an absolute value of an electric charge.

$$QP1<QP2<QP3<QP4<QP5 \quad (1)$$

The charges QM1, QM2, QM3, QM4, and QM5 of the respective toners TM1, TM2, TM3, TM4, and TM5 satisfy the relationship represented by the following expression (2).

$$QM1<QM2<QM3<QM4<QM5 \quad (2)$$

As illustrated in FIG. 4, the photosensitive drum 42*c* needs to have a higher electric potential than the primary transfer roller 51*c* in order to cause the toner TP1 included in the toner image formed on the photosensitive drum 42*c* to adhere to the intermediate transfer belt 54. In other words, the first voltage application section 61 controls the voltage to be applied between the primary transfer roller 51*c* and the photosensitive drum 42*c* so that the photosensitive drum 42*c* has a higher electric potential than the primary transfer roller 51*c*.

A voltage applied between a primary transfer roller 51 and a corresponding photosensitive drum 42 so that the photosensitive drum 42 has a higher electric potential than the primary transfer roller 51 is referred to as "positive polarity voltage". A voltage applied between a primary transfer roller 51 and a corresponding photosensitive drum 42 so that the photosensitive drum 42 has a lower electric potential than the primary transfer roller 51 is referred to as "opposite polarity voltage".

In FIGS. 4 to 7, a plus (+) sign given to a photosensitive drum 42 together with a minus (−) sign given to a primary transfer roller 51 indicates that the voltage therebetween is "positive polarity voltage". A minus (−) sign given to a photosensitive drum 42 together with a plus (+) sign given to a primary transfer roller 51 indicates that the voltage therebetween is "opposite polarity voltage".

In order to cause the toner TP1 included in the toner image formed on the photosensitive drum 42*m* to adhere to the intermediate transfer belt 54, the first voltage application section 61 applies positive polarity voltage between the primary transfer roller 51*m* and the photosensitive drum 42*m*. Likewise, in order to cause the toner TP1 included in the toner image formed on the photosensitive drum 42*y* to adhere to the intermediate transfer belt 54, the first voltage application section 61 applies positive polarity voltage between the primary transfer roller 51*y* and the photosensitive drum 42*y*. In order to cause the toner TP1 included in the toner image formed on the photosensitive drum 42*k* to adhere to the intermediate transfer belt 54, the second voltage application section 62 applies positive polarity voltage between the primary transfer roller 51*k* and the photosensitive drum 42*k*.

Next, behavior of the toner TP1 on the surface of the photosensitive drum 42*c* will be described. As illustrated in FIG. 4, positive polarity voltage is applied between the primary transfer roller 51*c* and the photosensitive drum 42*c*, and therefore the toner TP1 on the surface of the photosensitive drum 42*c* is caused to adhere to the intermediate transfer belt 54. The toner TP1 becomes charged to a slightly higher degree to be toner TP2 due to the positive polarity voltage as passing between the primary transfer roller 51*c* and the photosensitive drum 42*c*.

Positive polarity voltage is applied between the primary transfer roller 51*m* and the photosensitive drum 42*m*. Accordingly, the toner TP2 on the intermediate transfer belt 54 becomes charged to a much higher degree to be toner TP3 due to the positive polarity voltage as passing between the primary transfer roller 51*m* and the photosensitive drum 42*m*. Likewise, positive polarity voltage is applied between the primary transfer roller 51*y* and the photosensitive drum 42*y*. Accordingly, the toner TP3 on the intermediate transfer belt 54 becomes charged to a much, much higher degree to be toner TP4 due to the positive polarity voltage as passing between the primary transfer roller 51*y* and the photosensitive drum 42*y*. Likewise, positive polarity voltage is applied between the primary transfer roller 51*k* and the photosensitive drum 42*k*. Accordingly, the toner TP4 on the intermediate transfer belt 54 becomes charged to a very high degree to be toner TP5 due to the positive polarity voltage as passing between the primary transfer roller 51*k* and the photosensitive drum 42*k*.

Like the toner TP1 on the photosensitive drum 42*c* caused to adhere to the intermediate transfer belt 54, the toners TP1 on the surfaces of the other photosensitive drums 42*m*, 42*y*, and 42*k* are caused to adhere to the intermediate transfer belt 54. Thus, the toner images of the respective colors formed by the toners TP1 on the respective photosensitive drums 42 (42*c*, 42*m*, 42*y*, and 42*k*) are sequentially transferred onto the intermediate transfer belt 54 such that the toner images are superimposed on one another, and subsequently the superimposed toner images are transferred by the secondary transfer roller 52 from the intermediate transfer belt 54 to paper P (see FIG. 1).

When positive polarity voltage is applied to each primary transfer roller 51 and the corresponding photosensitive drum 42 in the forced toner discharge as in printing, as described above, the toner TP5 charged to a very high degree is caused to adhere to the intermediate transfer belt 54. Accordingly, adhesion between the toner TP5 and the intermediate transfer belt 54 is very strong, and therefore the toner TP5 adhering to the intermediate transfer belt 54 may not be removed by the blade 56.

First Embodiment

Figure 5:
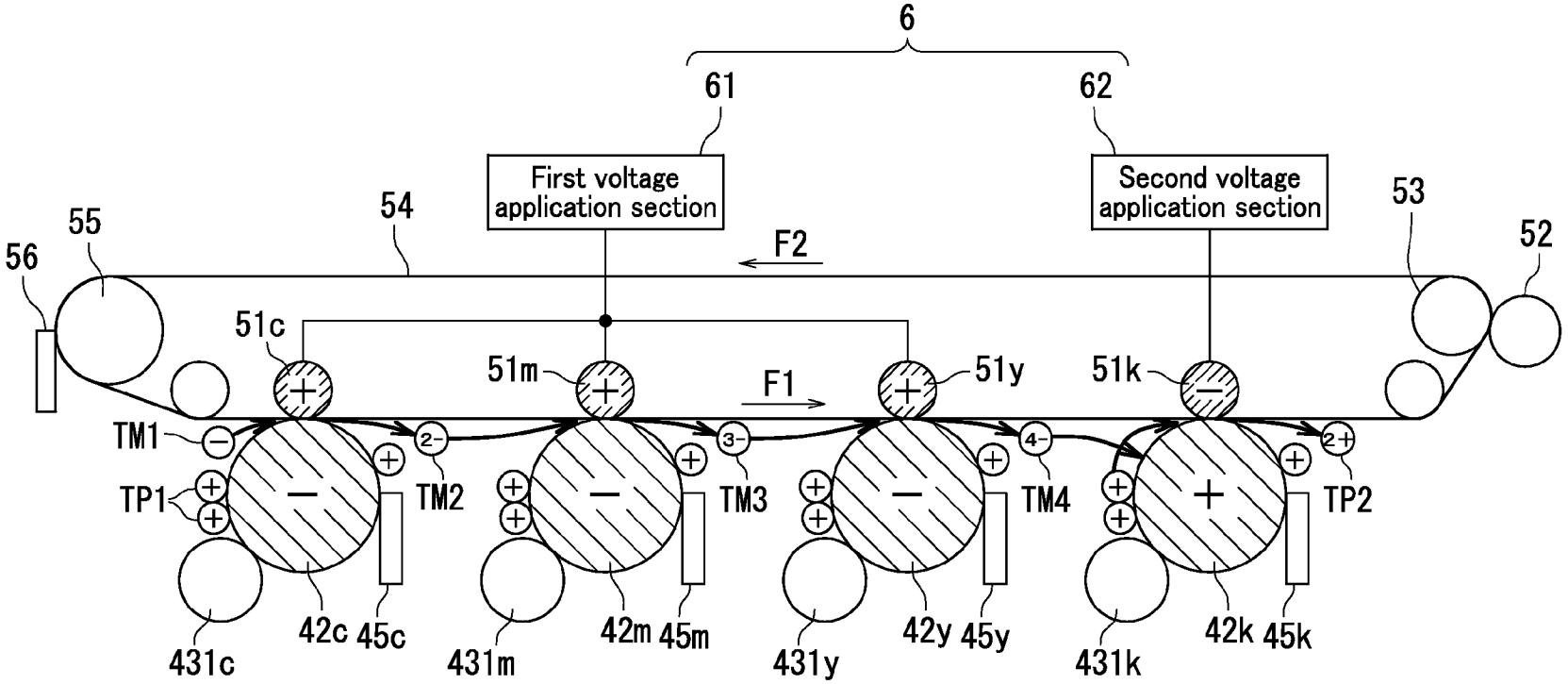
FIG. 5 is a side view illustrating operation of the voltage application section illustrated in FIG. 3 according to a first embodiment.

Next, operation of the voltage application section 6 according to the first embodiment will be described with reference to FIG. 5. FIG. 5 is a side view illustrating operation of the voltage application section 6 illustrated in FIG. 3 according to the first embodiment. In the first embodiment, as illustrated in FIG. 5, the first voltage application section 61 applies opposite polarity voltage, and the second voltage application section 62 applies positive polarity voltage. More specifically, the first voltage application section 61 applies opposite polarity voltage with respect to the three upstream primary transfer rollers 51*c*, 51*m*, and 51*y*, and the second voltage application section 62 applies positive polarity voltage with respect to the most downstream primary transfer roller 51*k*.

Next, the toner behavior in the first embodiment will be described. As illustrated in FIG. 5, opposite polarity voltage is applied between the primary transfer roller 51*c* and the photosensitive drum 42*c*, and therefore the toner TP1 on the surface of the photosensitive drum 42*c* is not caused to adhere to the intermediate transfer belt 54. In the present embodiment, positively charged toners are used to form an image on paper P as described above, but the photosensitive drum 42*c* also has some negatively charged toner thereon. The negatively charged toner TM1 on the surface of the photosensitive drum 42*c* is caused to adhere to the intermediate transfer belt 54. The toner TM1 becomes charged to a slightly higher degree to be toner TM2 due to the opposite polarity voltage as passing between the primary transfer roller 51*c* and the photosensitive drum 42*c*.

Opposite polarity voltage is applied between the primary transfer roller 51*m* and the photosensitive drum 42*m*. Accordingly, the toner TM2 on the intermediate transfer belt 54 becomes charged to a much higher degree to be toner TM3 due to the opposite polarity voltage as passing between the primary transfer roller 51*m* and the photosensitive drum 42*m*. Likewise, opposite polarity voltage is applied between the primary transfer roller 51*y* and the photosensitive drum 42*y*. Accordingly, the toner TM3 on the intermediate transfer belt 54 becomes charged to a much, much higher degree to be toner TM4 due to the opposite polarity voltage as passing between the primary transfer roller 51*y* and the photosensitive drum 42*y*.

Although not illustrated in FIG. 5, the toners TM1 on the surfaces of the photosensitive drums 42*m* and 42*y* are caused to adhere to the intermediate transfer belt 54 in the same way as the toner TM1 on the surface of the photosensitive drum 42*c* caused to adhere to the intermediate transfer belt 54.

Positive polarity voltage is applied between the primary transfer roller 51*k* and the photosensitive drum 42*k*. Accordingly, the toner TM4 on the intermediate transfer belt 54 is caused to adhere to the photosensitive drum 42*k*. The positively charged toner TP1 on the photosensitive drum 42*k* is caused to adhere to the intermediate transfer belt 54 due to the positive polarity voltage applied between the primary transfer roller 51*k* and the photosensitive drum 42*k*. Furthermore, the toner TP1 caused to adhere to the intermediate transfer belt 54 becomes charged to a slightly higher degree to be toner TP2 due to the positive polarity voltage as passing between the primary transfer roller 51*k* and the photosensitive drum 42*k*.

Thus, as a result of the opposite polarity voltage applied with respect to the three upstream primary transfer rollers 51*c*, 51*m*, and 51*y*, and the positive polarity voltage applied with respect to the most downstream primary transfer roller 51*k*, the intermediate transfer belt 54 has the toner TP2 charged to a slightly higher degree thereon. Since the toner TP2 is not charged to a very high degree, adhesion (Coulomb's force) between the toner TP2 and the intermediate transfer belt 54 is not high. The toner TP2 adhering to the intermediate transfer belt 54 can therefore be removed easily by the blade 56. As a result, occurrence of poor cleaning of the intermediate transfer belt 54 in the forced toner discharge can be reduced.

Second Embodiment

Next, operation of the voltage application section 6 according to the second embodiment will be described with reference to FIG. 6. The second embodiment of the voltage application section 6 is different from the first embodiment in that the polarity of the voltage to be applied by the first voltage application section 61 and the polarity of the voltage to be applied by the second voltage application section 62 are reversed.

Figure 6:
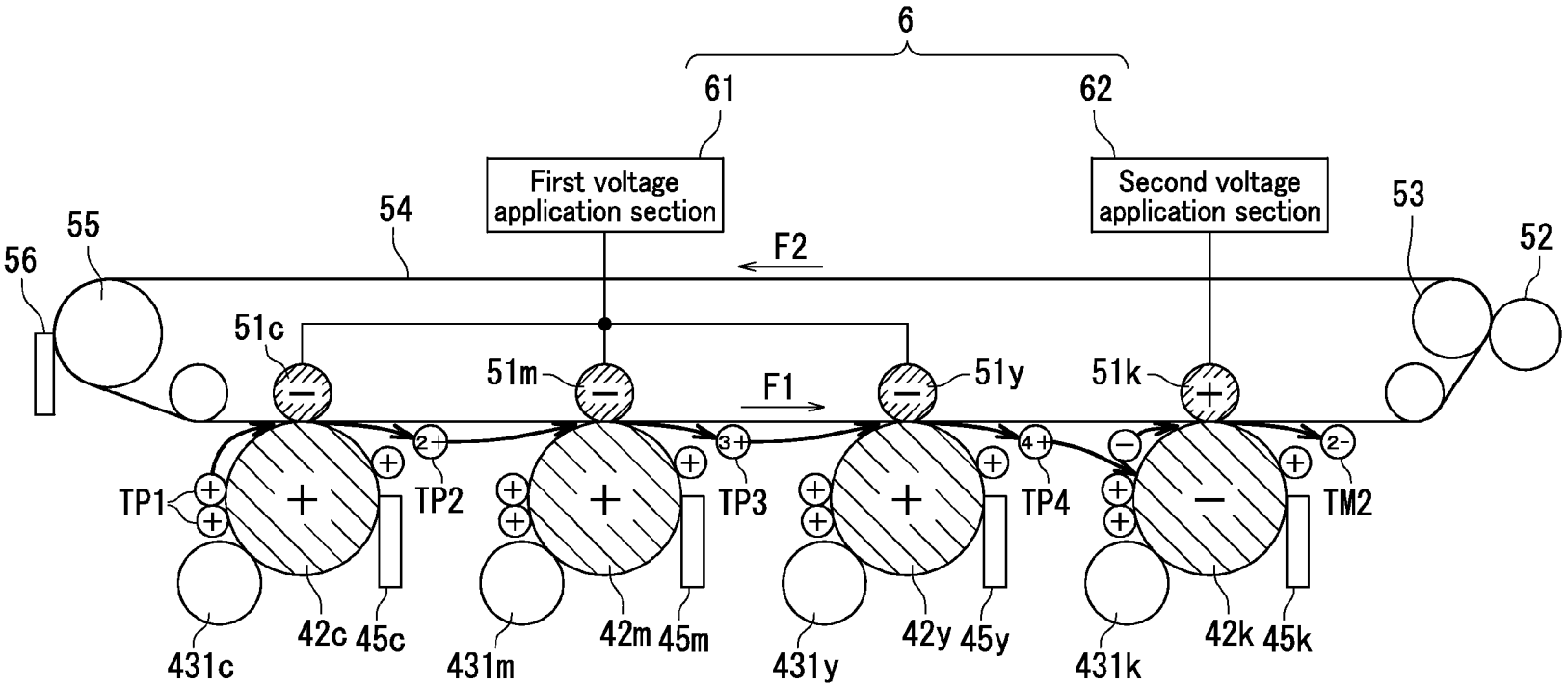
FIG. 6 is a side view illustrating operation of the voltage application section illustrated in FIG. 3 according to a second embodiment.

FIG. 6 is a side view illustrating operation of the voltage application section 6 illustrated in FIG. 3 according to the second embodiment. In the second embodiment, as illustrated in FIG. 6, the first voltage application section 61 applies positive polarity voltage and the second voltage application section 62 applies opposite polarity voltage. More specifically, the first voltage application section 61 applies positive polarity voltage with respect to the three upstream primary transfer rollers 51*c*, 51*m*, and 51*y*, and the second voltage application section 62 applies opposite polarity voltage with respect to the most downstream primary transfer roller 51*k*.

Next, the toner behavior in the second embodiment will be described. As illustrated in FIG. 6, positive polarity voltage is applied between the primary transfer roller 51*c* and the photosensitive drum 42*c*, and therefore the toner TP1 on the surface of the photosensitive drum 42*c* is caused to adhere to the intermediate transfer belt 54. The toner TP1 becomes charged to a slightly higher degree to be toner TP2 due to the positive polarity voltage as passing between the primary transfer roller 51*c* and the photosensitive drum 42*c*.

Positive polarity voltage is applied between the primary transfer roller 51*m* and the photosensitive drum 42*m*. Accordingly, the toner TP2 on the intermediate transfer belt 54 becomes charged to a much higher degree to be toner TP3 due to the positive polarity voltage as passing between the primary transfer roller 51*m* and the photosensitive drum 42*m*. Likewise, positive polarity voltage is applied between the primary transfer roller 51*y* and the photosensitive drum 42*y*. Accordingly, the toner TP3 on the intermediate transfer belt 54 becomes charged to a much, much higher degree to be toner TP4 due to the positive polarity voltage as passing between the primary transfer roller 51*y* and the photosensitive drum 42*y*.

Although not illustrated in FIG. 6, the toners TP1 on the surfaces of the photosensitive drums 42*m* and 42*y* are caused to adhere to the intermediate transfer belt 54 in the same way as the toner TP1 on the surface of the photosensitive drum 42*c* caused to adhere to the intermediate transfer belt 54.

Since opposite polarity voltage is applied between the primary transfer roller 51*k* and the photosensitive drum 42*k*, the toner TP4 on the intermediate transfer belt 54 is caused to adhere to the photosensitive drum 42*k*. Likewise, since opposite polarity voltage is applied between the primary transfer roller 51*k* and the photosensitive drum 42*k*, the toner TM1 on the photosensitive drum 42*k* is caused to adhere to the intermediate transfer belt 54. Furthermore, the toner TM1 caused to adhere to the intermediate transfer belt 54 becomes charged to a slightly higher degree to be toner TM2 due to the opposite polarity voltage as passing between the primary transfer roller 51*k* and the photosensitive drum 42*k*.

Thus, as a result of the positive polarity voltage applied with respect to the three upstream primary transfer rollers 51*c*, 51*m*, and 51*y*, and the opposite polarity voltage applied with respect to the most downstream primary transfer roller 51*k*, the intermediate transfer belt 54 has the toner TM2 charged to a slightly higher degree thereon. Since the toner TM2 is not charged to a very high degree, adhesion (Coulomb's force) between the toner TM2 and the intermediate transfer belt 54 is not strong. The toner TM2 adhering to the intermediate transfer belt 54 can therefore be removed easily by the blade 56. As a result, occurrence of poor cleaning of the intermediate transfer belt 54 in the forced toner discharge can be reduced.

FIRST COMPARATIVE EXAMPLE

Figure 7:
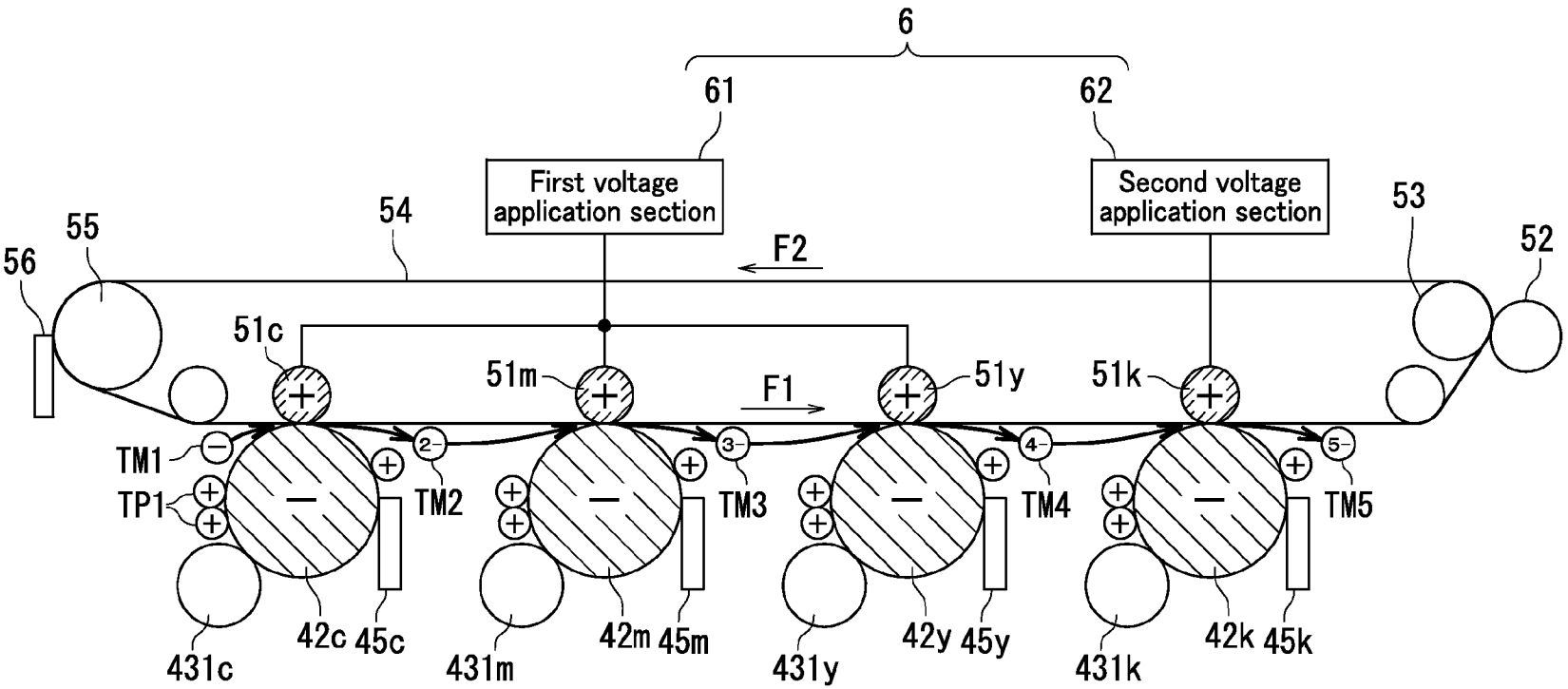
FIG. 7 is a side view illustrating operation of the voltage application section illustrated in FIG. 3 according to a first comparative example.

Next, operation of the voltage application section 6 according to the first comparative example will be described with reference to FIG. 7. FIG. 7 is a side view illustrating operation of the voltage application section 6 illustrated in FIG. 3 according to the first comparative example. In the first comparative example, as illustrated in FIG. 7, the first voltage application section 61 and the second voltage application section 62 apply opposite polarity voltage. More specifically, the first voltage application section 61 applies opposite polarity voltage with respect to the three upstream primary transfer rollers 51*c*, 51*m*, and 51*y*, and the second voltage application section 62 applies opposite polarity voltage to the most downstream primary transfer roller 51*k*.

As illustrated in FIG. 7, opposite polarity voltage is applied between the primary transfer roller 51*c* and the photosensitive drum 42*c*, and therefore the toner TP1 on the surface of the photosensitive drum 42*c* is not caused to adhere to the intermediate transfer belt 54. In the present embodiment, positively charged toners are used to form an image on paper P as described above, but the photosensitive drum 42*c* also has some negatively charged toner thereon. Since opposite polarity voltage is applied between the primary transfer roller 51*c* and the photosensitive drum 42*c*, the negatively charged toner TM1 on the photosensitive drum 42*c* is caused to adhere to the intermediate transfer belt 54. The toner TM1 becomes charged to a slightly higher degree to be toner TM2 due to the opposite polarity voltage as passing between the primary transfer roller 51*c* and the photosensitive drum 42*c*.

Opposite polarity voltage is applied between the primary transfer roller 51*m* and the photosensitive drum 42*m*. Accordingly, the toner TM2 on the intermediate transfer belt 54 becomes charged to a much higher degree to be toner TM3 due to the opposite polarity voltage as passing between the primary transfer roller 51*m* and the photosensitive drum 42*m*. Likewise, opposite polarity voltage is applied between the primary transfer roller 51*y* and the photosensitive drum 42*y*.

Accordingly, the toner TM3 on the intermediate transfer belt 54 becomes charged to a much, much higher degree to be toner TM4 due to the opposite polarity voltage as passing between the primary transfer roller 51*y* and the photosensitive drum 42*y*. Likewise, opposite polarity voltage is applied between the primary transfer roller 51*k* and the photosensitive drum 42*k*. Accordingly, the toner TM4 on the intermediate transfer belt 54 becomes charged to a very high degree to be toner TM5 due to the opposite polarity voltage as passing between the primary transfer roller 51*k* and the photosensitive drum 42*k*.

Thus, as a result of the opposite polarity voltage applied between the upstream primary transfer rollers 51 and the photosensitive drums 42, the toner TM5 charged to a very high degree is caused to adhere to the intermediate transfer belt 54. Accordingly, in a configuration in which opposite polarity voltage is applied between the primary transfer rollers 51 and the photosensitive drums 42 in the forced toner discharge, the toner TM5 adhering to the intermediate transfer belt 54 may not be removed by the blade 56.

Next, the relationship between occurrence of poor cleaning of the intermediate transfer belt 54 and the polarity of the voltage to be applied by the first voltage application section 61 and the polarity of the voltage to be applied by the second voltage application section 62 will be described with reference to FIGS. 8A to 8E. FIGS. 8A to 8E are tables for evaluation of results of the cleaning performed by the blade 56 according to the configurations illustrated in FIGS. 5 to 7. FIG. 8A shows results of the cleaning according to the first comparative example. FIG. 8B shows results of the cleaning according to the second embodiment. FIGS. 8C to 8E show results of the cleaning according to the first embodiment illustrated in FIG. 5.

The left column of each of the tables shown in FIGS. 8A to 8E shows the polarity of the voltage applied with respect to the three upstream primary transfer rollers 51*c*, 51*m*, and 51*y*, and the values of the electric current (μA) flowing through the primary transfer rollers 51*c*, 51*m*, and 51*y*. The middle column shows the polarity of the voltage applied to the most downstream primary transfer roller 51*k* and the values of the electric current (μA) flowing through the primary transfer roller 51*k*. The electric current flowing through each primary transfer roller 51 is positive when flowing from the primary transfer roller 51 to the corresponding photosensitive drum 42. The right column shows occurrence of poor cleaning of the intermediate transfer belt 54 by the blade 56. The letter "B" indicates that poor cleaning occurred. The letter "A" indicates that poor cleaning did not occur.

First, the results of the cleaning according to the first comparative example will be described with reference to FIG. 8A. In the first comparative example, all the primary transfer rollers 51 receive opposite polarity voltage. In this configuration, as shown in FIG. 8A, poor cleaning of the intermediate transfer belt 54 occurred when the values of the electric current flowing through the primary transfer rollers 51 were in a range of 1 μA to 5 μA.

Next, the results of the cleaning according to the second embodiment will be described with reference to FIG. 8B. In the second embodiment, the three upstream primary transfer rollers 51*c*, 51*m*, and 51*y* receive positive polarity voltage, and the most downstream primary transfer roller 51*k* receives opposite polarity voltage. In this configuration, as shown in FIG. 8B, poor cleaning of the intermediate transfer belt 54 did not occur when the absolute values of the electric current flowing through the primary transfer rollers 51 were in a range of 1 μA to 5 μA.

It is therefore possible to reduce occurrence of poor cleaning of the intermediate transfer belt 54 in the forced toner discharge by applying positive polarity voltage with respect to the three upstream primary transfer rollers 51*c*, 51*m*, and 51*y*, and opposite polarity voltage with respect to the most downstream primary transfer roller 51*k*.

Preferably, as shown in FIG. 8B, positive polarity voltage is applied with respect to the three upstream primary transfer rollers 51*c*, 51*m*, and 51*y* so that the absolute values of the electric current flowing through the three upstream primary transfer rollers 51*c*, 51*m*, 51*y* are within the range of 1 μA to 5 μA, and opposite polarity voltage is applied with respect to the most downstream primary transfer roller 51*k* so that the value of the electric current flowing through the most downstream primary transfer roller 51*k* is within the range of 1 μA to 5 μA.

Next, the results of the cleaning in a configuration according to the first embodiment in which no voltage is applied with respect to the most downstream primary transfer roller 51*k* will be described with reference to FIG. 8C. In the first embodiment, the three upstream primary transfer rollers 51*c*, 51*m*, and 51*y* receive positive polarity voltage, and the most downstream primary transfer roller 51*k* receives no voltage (or receive positive polarity voltage). In this configuration, as shown in FIG. 8C, poor cleaning of the intermediate transfer belt 54 did not occur when the absolute values of the electric current flowing through the three upstream primary transfer rollers 51*c*, 51*m*, and 51*y* were in a range of 1 μA to 5 μA.

It is therefore possible to reduce occurrence of poor cleaning of the intermediate transfer belt 54 in the forced toner discharge by applying opposite polarity voltage with respect to the three upstream primary transfer rollers 51*c*, 51*m*, and 51*y*, and no voltage with respect to the most downstream primary transfer roller 51*k*.

Preferably, as shown in FIG. 8C, opposite polarity voltage is applied with respect to the three upstream primary transfer rollers 51*c*, 51*m*, and 51*y* so that the values of the electric current flowing through the three upstream primary transfer rollers 51*c*, 51*m*, 51*y* are within the range of 1 μA to 5 μA.

Next, the results of the cleaning in a configuration according to the first embodiment in which positive polarity voltage is applied with respect to the most downstream primary transfer roller 51*k* will be described with reference to FIGS. 8D and 8E. In the first embodiment, the three upstream primary transfer rollers 51*c*, 51*m*, and 51*y* receive opposite polarity voltage, and the most downstream primary transfer roller 51*k* receives positive polarity voltage (or no voltage). In this configuration, as shown in FIG. 8D, poor cleaning of the intermediate transfer belt 54 did not occur when the value of the electric current flowing through the most downstream primary transfer roller 51*k* was "−3 μA", and the values of the electric current flowing through the three upstream primary transfer rollers 51*c*, 51*m*, and 51*y* were within the range of 1 μA to 5 μA. Furthermore, as shown in FIG. 8E, poor cleaning of the intermediate transfer belt 54 did not occur when the value of the electric current flowing through the most downstream primary transfer roller 51*k* was "−5 μA", and the values of the electric current flowing through the three upstream primary transfer rollers 51*c*, 51*m*, and 51*y* were within the range of 1 μA to 5 μA.

It is therefore possible to reduce occurrence of poor cleaning of the intermediate transfer belt 54 in the forced toner discharge by applying opposite polarity voltage with respect to the three upstream primary transfer rollers 51*c*, 51*m*, and 51*y*, and positive polarity voltage with respect to the most downstream primary transfer roller 51*k*.

Preferably, as shown in FIGS. 8D and 8E, opposite polarity voltage is applied with respect to the three upstream primary transfer rollers 51*c*, 51*m*, and 51*y* so that the values of the electric current flowing through the three upstream primary transfer rollers 51*c*, 51*m*, 51*y* are within the range of 1 μA to 5 μA. Preferably, positive polarity voltage is applied to the most downstream primary transfer roller 51*k* so that the absolute value of the electric current flowing through the most downstream primary transfer roller 51*k* is no greater than 5 μA.

The embodiments of the present disclosure have been described with reference to the drawings so far. However, the present disclosure is not limited to the above embodiments and may be practiced in various forms without deviating from the essence thereof (for example, as explained below in sections (1) to (5)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiments, such as shapes and dimensions, are merely examples and are not intended as specific limitations. Various alterations may be made so long as there is no substantial deviation from the effects of the present disclosure.

(1) The first and second embodiments are described for a configuration in which the image forming apparatus 1 includes the four primary transfer rollers 51*c*, 51*m*, 51*y*, and 51*k*, and the four photosensitive drums 42*c*, 42*m*, 42*y*, and 42*k*. However, the present disclosure is not limited to the configuration. The image forming apparatus 1 may include any number of primary transfer rollers and photosensitive drums so long as the number is two or more. For example, the number may be two, three, or five or more.

(2) The first embodiment is described for a configuration in which the values of the electric current flowing through the three upstream primary transfer rollers 51*c*, 51*m*, and 51*y* are within the range of 1 μA to 5 μA, and the absolute value of the electric current flowing through the most downstream primary transfer roller 51*k* is no greater than 5 μA. However, the present disclosure is not limited to the configuration. The values of the electric current may be out of the above-specified ranges. For example, the values of the electric current flowing through the three upstream primary transfer rollers 51*c*, 51*m*, and 51*y* may be 6 μA, and the absolute value of the electric current flowing through the most downstream primary transfer roller 51*k* may be 6 μA.

(3) The second embodiment is described for a configuration in which the absolute values of the electric current flowing through the three upstream primary transfer rollers 51*c*, 51*m*, and 51*y* are within the range of 1 μA to 5 μA, and the value of the electric current flowing through the most downstream primary transfer roller 51*k* is within the range of 1 μA to 5 μA. However, the present disclosure is not limited to the configuration. The values of the electric current may be out of the above-specified ranges. For example, the absolute values of the electric current flowing through the three upstream primary transfer rollers 51*c*, 51*m*, and 51*y* may be 6 μA, and the value of the electric current flowing through the most downstream primary transfer roller 51*k* may be 0.5 μA.

(4) The first and second embodiments are described for a configuration in which discharging of each of the toners in the development sections 43 (43*c*, 43*m*, 43*y*, and 43*k*) is timed with transferring of each toner image onto the intermediate transfer belt 54 such that the toner images are superimposed on one another. However, the present disclosure is not limited to the configuration. For example, the discharging may be performed such that the toner images are not superimposed on one another. In such a configuration, control for superimposing the toner images is not necessary.

(5) The first and second embodiments are described for a configuration in which positively charged toners are used to form an image on paper P. However, the present disclosure is not limited to the configuration. Negatively charged toners may be used to form an image on paper P.

What is claimed is:

1. An image forming apparatus for forming an image on a recording medium, comprising:

a plurality of photosensitive drums;

a plurality of development sections provided in one-to-one correspondence with the photosensitive drums and configured to supply toners to the respective photosensitive drums to form a plurality of toner images each having a different color on the respective photosensitive drums;

a plurality of primary transfer rollers disposed opposite to the photosensitive drums in one-to-one correspondence;

an intermediate transfer belt that is held between the photosensitive drums and the primary transfer rollers, and onto which the toner images are transferred such that the toner images are superimposed on one another for forming the image; and a voltage application section configured to apply voltage to a plurality of voltage application regions between each of the photosensitive drums and the corresponding one of the primary transfer rollers, wherein in forced toner discharge from the development sections, the voltage application section:

applies voltage of the same polarity to each voltage application region other than a most downstream voltage application region among the plurality of voltage application regions, the most downstream voltage application region being located most downstream in a traveling direction of the intermediate transfer belt; and applies, to the most downstream voltage application region, voltage of a polarity opposite to the polarity of the voltage that is applied to each voltage application region other than the most downstream voltage application region.

2. An image forming apparatus for forming an image on a recording medium, comprising:

a plurality of photosensitive drums;

a plurality of development sections provided in one-to-one correspondence with the photosensitive drums and configured to supply toners to the respective photosensitive drums to form a plurality of toner images each having a different color on the respective photosensitive drums;

a plurality of primary transfer rollers disposed opposite to the photosensitive drums in one-to-one correspondence;

an intermediate transfer belt that is held between the photosensitive drums and the primary transfer rollers, and onto which the toner images are transferred such that the toner images are superimposed on one another for forming the image; and a voltage application section configured to apply voltage to a plurality of voltage application regions between each of the photosensitive drums and the corresponding one of the primary transfer rollers, wherein in forced toner discharge in which the toners in the development sections are each forced out to the photosensitive drums in order to adjust a charge state of each of the toners in the development sections and the toner images on the intermediate transfer belt are not transferred to the recording medium, the voltage application section:

applies voltage of the same polarity to each voltage application region other than a most downstream voltage application region among the plurality of voltage application regions, the most downstream voltage application region being located most downstream in a traveling direction of the intermediate transfer belt; and applies substantially no voltage to the most downstream voltage application region.

3. The image forming apparatus according to claim 1, wherein in the forced toner discharge from the development sections, a plurality of toner images each having a different color formed on the respective photosensitive drums are transferred onto the intermediate transfer belt such that the toner images are superimposed on one another.

4. The image forming apparatus according to claim 1, wherein in the forced toner discharge, the voltage application section applies the voltage to each voltage application region other than the most downstream voltage application region among the plurality of voltage application regions so that an electric current of 1 μA to 5 μA flows therethrough and applies the voltage to the most downstream voltage application region so that an electric current of 0 to 5 μA flows therethrough.

5. The image forming apparatus according to claim 1, wherein in the forced toner discharge, the voltage application section applies, to each voltage application region other than the most downstream voltage application region among the plurality of voltage application regions, voltage of a polarity opposite to a polarity of voltage that is applied thereto in normal printing.

6. The image forming apparatus according to claim 1, wherein the voltage application section includes:

a first voltage application section configured to apply the voltage to each voltage application region other than the most downstream voltage application region among the plurality of voltage application regions; and a second voltage application section configured to apply the voltage to the most downstream voltage application region.

7. The image forming apparatus according to claim 2, wherein in the forced toner discharge from the development sections, a plurality of toner images each having a different color formed on the respective photosensitive drums are transferred onto the intermediate transfer belt such that the toner images are superimposed on one another.

8. The image forming apparatus according to claim 2, wherein in the forced toner discharge, the voltage application section applies the voltage to each voltage application region other than the most downstream voltage application region among the plurality of voltage application regions so that an electric current of 1 μA to 5 μA flows therethrough.

9. The image forming apparatus according to claim 2, wherein in the forced toner discharge, the voltage application section applies, to each voltage application region other than the most downstream voltage application region among the plurality of voltage application regions, voltage of a polarity opposite to a polarity of voltage that is applied thereto in normal printing.

10. The image forming apparatus according to claim 2, wherein the voltage application section includes:

a first voltage application section configured to apply the voltage to each voltage application region other than the most downstream voltage application region among the plurality of voltage application regions; and a second voltage application section configured to apply the voltage to the most downstream voltage application region.

* * * * *